US006389726B1

(12) United States Patent
Bentley

(10) Patent No.: US 6,389,726 B1
(45) Date of Patent: May 21, 2002

(54) GUN LOCK ASSEMBLY

(76) Inventor: James K. Bentley, P.O. Box 2848, Paso Robles, CA (US) 93447

( * ) Notice: Subject to any disclaimer, the term of this patent is extended or adjusted under 35 U.S.C. 154(b) by 0 days.

(21) Appl. No.: 09/680,234

(22) Filed: Oct. 5, 2000

(51) Int. Cl.[7] ..... F41A 17/54

(52) U.S. Cl. ..... 42/70.07; 42/70.06; 42/70.11

(58) Field of Search ..... 42/70.01, 70.06, 42/70.07, 70.11

(56) References Cited

U.S. PATENT DOCUMENTS

| | | | | | |
|---|---|---|---|---|---|
| 2,948,978 | A | * | 8/1960 | Salverda | 42/1 |
| 3,964,200 | A | * | 6/1976 | Patterson | 42/70 E |
| 5,024,017 | A | * | 6/1991 | Nishioka | 42/70.07 |
| 5,075,994 | A | * | 12/1991 | Nishioka | 42/70.07 |
| 5,680,723 | A | * | 10/1997 | Ruiz | 42/70.11 |
| 6,253,480 | B1 | * | 7/2001 | Florez | 42/70.11 |

* cited by examiner

*Primary Examiner*—Michael J. Carone
*Assistant Examiner*—Gabriel S Sukman
(74) *Attorney, Agent, or Firm*—Charles C. Logan, II

(57) ABSTRACT

A dual locking system for a firearm that allows the owner to keep a loaded gun unlocked for protection purposes while maintaining maximum security from a child's being able to fire the weapon. The gun lock assembly has a lock housing and a lock housing support assembly as its major structure. The lock housing support assembly is secured to the vertical leg portion of the trigger guard of the firearm. The lock housing is an elongated tubular member having a lock assembly mounted in its front end. Internal grooves in the lock housing act as a track for guiding it onto the lock housing support assembly. There is a spring loaded release button mounted on the bottom wall of the lock housing support assembly that travels along the inner surface of the bottom wall of the lock housing. The release button can drop into either one of two apertures in the bottom wall to provide two specific positions for the lock housing on the handgun. In the rearmost position, the trigger is completely hidden from view. In the forward position, the trigger is accessible and the firearm can be fired. The force required to depress the release button is sufficient to make it childproof and there is further structure in the form of a plastic overmold layer that conceals the location of the release button.

12 Claims, 2 Drawing Sheets

GUN LOCK ASSEMBLY

BACKGROUND OF THE INVENTION

The invention relates to a lock assembly and more specifically to a gun lock assembly.

A major concern of gun owners is that unauthorized access to loaded guns often results in accidental injury or a death of a person. All too often a child finds a loaded gun resulting in their being shot/or the shooting the gun and injuring another person.

Another major concern is for one's personal safety and protection from persons breaking into the home and the need to have a loaded gun to defend oneself.

It is an object of the invention to provide a novel gun lock assembly that can be easily installed on the trigger guard of a firearm.

It is another object of the invention to provide a novel gun lock assembly that prevents a loaded firearm from being fired by anyone not having the key to unlock the lock.

It is also an object of the invention to provide a novel gun lock assembly that allows the lock housing to be slid forwardly far enough after being unlocked so that the firearm can be fired without the lock housing being removed from the firearm.

It is a further object of the invention to provide a novel gun lock assembly that is economical to manufacture and market.

It is an additional object of the invention to provide a novel gun lock assembly that can be made in different models that will work with handguns and rifles.

It is also an object of the invention to provide a novel gun lock assembly that allows the owner to keep a loaded gun unlocked for instantaneous protection.

It is another object of the invention to provide a novel gun lock assembly which when unlocked cannot be slid forwardly by a child to a position making it possible to fire the handgun.

SUMMARY OF THE INVENTION

The gun lock assembly provides a dual locking system for a firearm such as a handgun or a rifle. When the lock housing is slid rearwardly on the lock housing support assembly this position completely hides the trigger of the firearm. Next the key in the lock assembly is turned to a vertical position and removed. Noone is then able to access the trigger of the firearm.

The novel gun lock assembly has been designed to allow the owner to keep a loaded firearm immediately available for protection and use, by turning the key of the lock assembly to its horizontal unlocked position and removing the key. The spring loaded release buttons in the bottom of the lock housing are depressed upwardly a sufficient distance to release the lock housing for a sliding movement forwardly to a position that uncovers the trigger of the firearm. This allows a person to shoot the firearm with out removing the gunlock assembly. The pressure required to depress the release buttons is sufficient enough to make it inoperable by a small child and therefore deny access to the trigger of the gun by a small child.

A second structure to deter access to the trigger by a small child is the release buttons and their actuating mechanism. They would not be visible because the bottom wall of the lock housing would be covered by an overmolded layer of plastic material hiding the release buttons concealing any indication that there is an actuating mechanism under the surface of the plastic overmold layer.

The novel gun lock assembly allows a person to keep a loaded gun readily available for immediate access if threatened by an intruder trying to break into their home. The gun owner can access use of the handgun in an instant by depressing the spring loaded button on the bottom wall of the lock housing and pulling rearwardly on the handgun to uncover the trigger so that the handgun can be ready to fire.

The gun lock assembly has two primary components, the lock housing and the lock housing support assembly. The lock housing support assembly is attached to the vertical leg portion of the trigger guard and would normally remain thereon, except when it would be desired to remove the entire gunlock assembly. The lock housing has a tubular shape with internal left and right side wall grooves that mate with the external configuration of the lock housing support assembly. The grooves form a track to make the lock housing easily slidable onto the lock housing support assembly.

The lock housing support assembly has a latch positioned adjacent its front end which interacts with the latch finger on the lock assembly. When the lock housing is pushed to the rearward most position on the handgun, the lock key is turned to the vertical upright position causing the latch finger to travel upwardly into the latch member which prevents forward longitudinal motion or sliding motion of the lock housing. Once the key is removed, no one has access to the trigger of the firearm unless they have the key.

The bottom wall of the lock housing has two longitudinally spaced apertures. At the rear of the interior bottom wall a ramp is formed for the purpose discussed below. The lock housing support assembly has a spring loaded release button extending from its bottom end that rides up the ramp as the lock housing is slid rearwardly over the lock housing support assembly. When the spring loaded release button drops into the first aperture, the trigger is still accessible and the gun may be fired. By pushing the bottom of the spring loaded release button up far enough into the interior of the lock housing, the lock housing can be slid rearwardly a further distance until the spring loaded release button drops into the second aperture. At that position, the side walls of the lock housing completely hide the trigger of the firearm from view and make it inaccessible.

The force required to depress the spring loaded release button is designed to prevent a small child from being able to depress the release button a sufficient distance that would allow him to slide the lock housing forward. Also, the bottom surface of the lock housing has a plastic overmold layer that conceals the existence of the release button making it even more child proof.

THE DESCRIPTION OF THE DRAWINGS

DESCRIPTION OF THE PREFERRED EMBODIMENT

Figure 1:
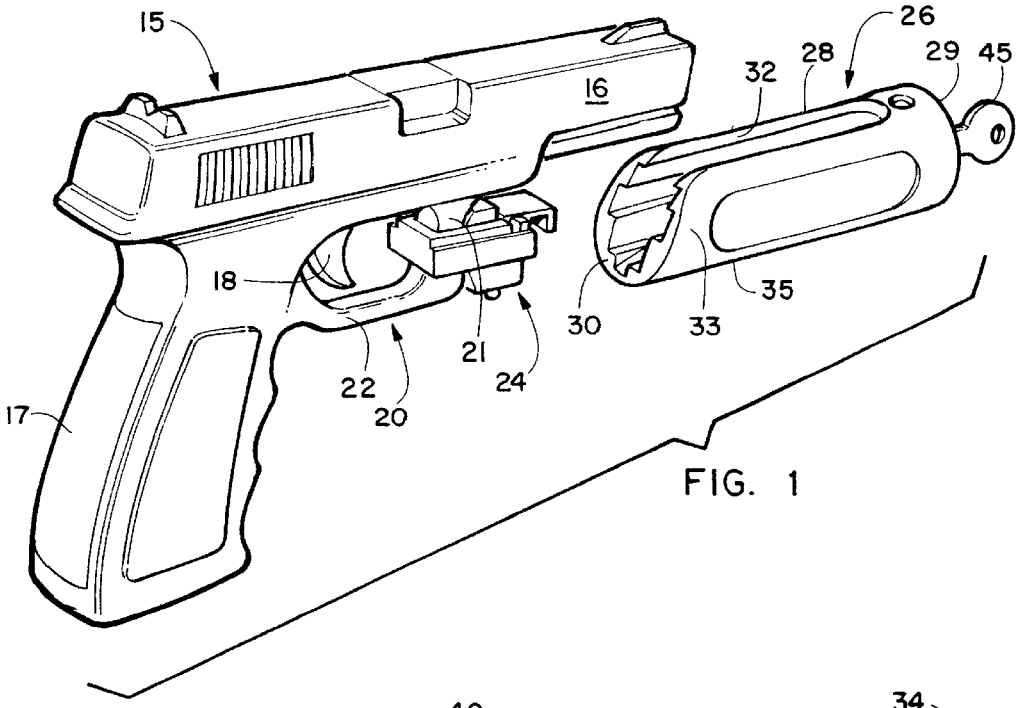
FIG. 1 is an exploded rear perspective view showing the lock housing removed.
Figure 2:
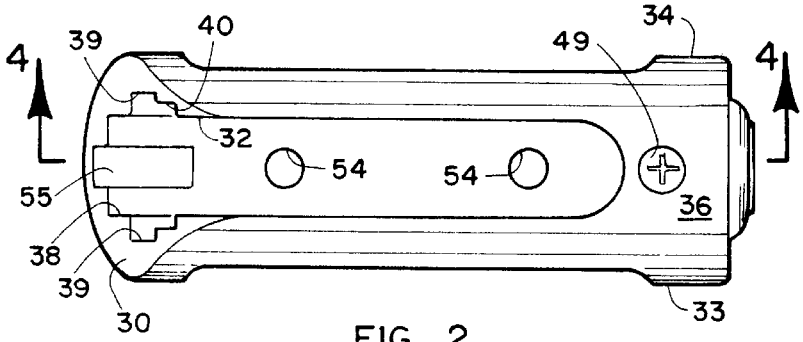
FIG. 2 is a top plan view of the lock housing.
Figure 3:
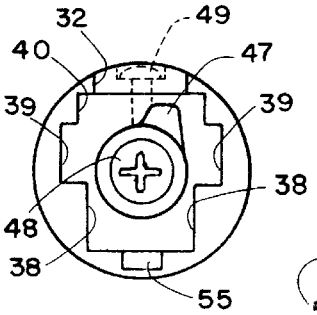
FIG. 3 is a rear end view of the lock housing.
Figure 4:
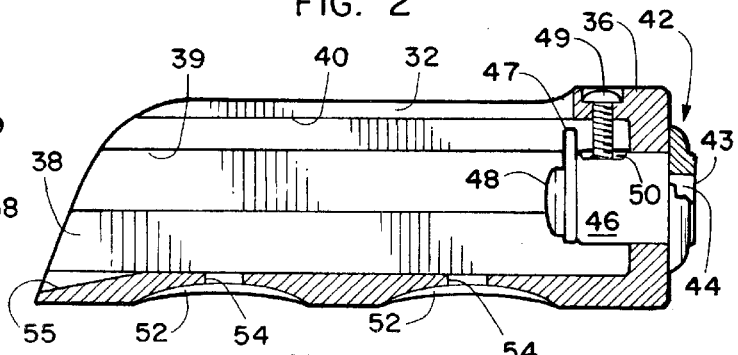
FIG. 4 is a vertical cross section taken through the lock housing.
Figure 5:
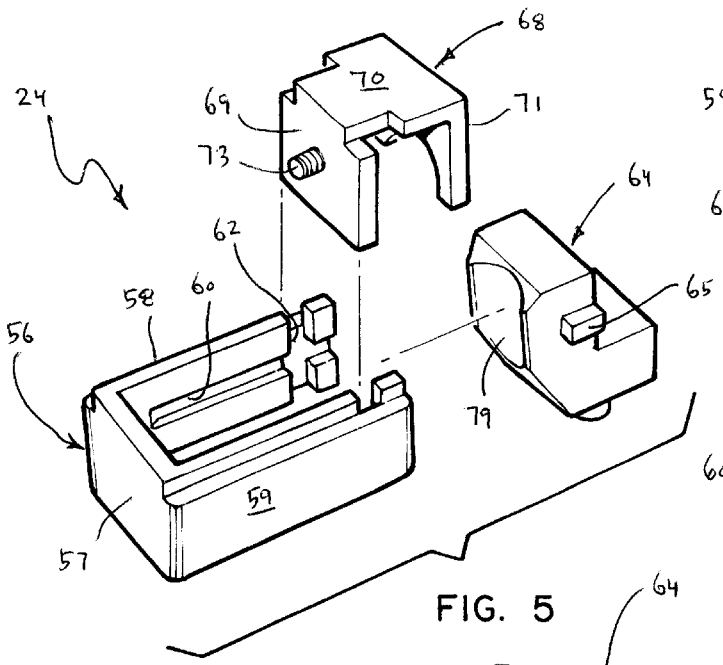
FIG. 5 is an exploded rear perspective view of the lock housing support assembly.
Figure 6:
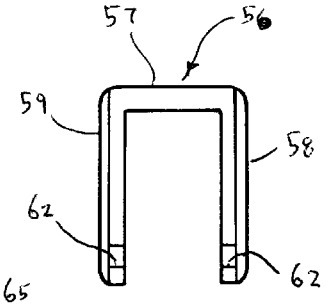
FIG. 6 is a top plan view of the U-shaped bracket.
Figure 7:
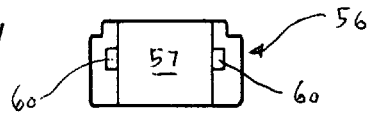
FIG. 7 is a front elevation view of the U-shaped bracket.
Figure 10:
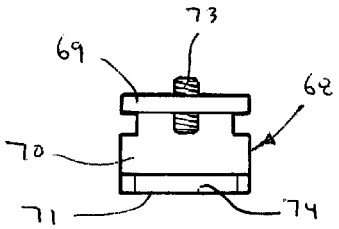
FIG. 10 is a bottom plan view of the latch member.

In FIG. 1, the handgun is generally designated numeral 15. It has a gun barrel 16, a handgrip 17, a trigger 18 and a trigger guard 20. Trigger guard 20 has a vertical leg portion 21 and a horizontal leg portion 22. A lock housing support assembly 24 is attached to vertical leg portion 21. Lock housing 26 is slidable upon lock housing port assembly from a position completely removed to a rear position shown by dash lines in which the trigger 18 is hidden from view.

The structure of lock housing 26 will now be described in detail by referring to FIGS. 1–4. It has a tubular sleeve 28 having a front end 29 and a rear end 30. It has a top wall slot 32, a left side wall 33, a right side wall 34, a bottom wall 35 and a top wall 36. The interior surface of side walls 33 and 34 would be substantially identical and only side wall 33 will be described in FIG. 4. It has an interior surface 38 having a longitudinally extending groove 39 and a shoulder 40. The structure of the side walls of the lock housing support assembly mate or interlock in this structure as lock housing 26 is slid thereon. A lock assembly 42 is mounted in the front end of lock housing 26. It has a lock cylinder 43, a key slot 44, a key 45, a tubular sleeve 46, a latch finger 47 and a screw 48. Sleeve 46 has a recess 50 formed in its top surface that receives the bottom end of a screw 49. By rotating key 45, latch finger 47 will travel from a vertical locking position to a horizontal unlock position. Bottom wall 35 has a pair of longitudinally spaced recesses 52 formed in its outer surface and each recess has a release button aperture 54. The top surface of bottom wall 35 has a ramp 55 formed at its rear end.

Lock housing support assembly 24 will now be described by referring to FIGS. 5–11. It has a U-shaped bracket 56 open at its front end. It has a rear wall 57, a left side wall 58 and a right side wall 59. Longitudinally extending grooves 60 are formed along the inner surface of the respective side walls 58 and 59. A vertical groove 62 is formed on the inner surface of the same respective side walls. The U-shaped bracket 56 is installed on the vertical leg portion 21 of trigger guard 20. An L-shaped plug member 64 closes the front end of U-shaped bracket 56 and it is slid therein with its respective ears 65 sliding in the respective grooves 60. The remaining structure of L-shaped plug member 64 will be described later. Latch member 68 has a rear wall 69, a top wall 70, and a front wall 71. A set screw 73 passes through rear wall 69. Front wall 71 has a concave bottom edge 74.

Figure 8:
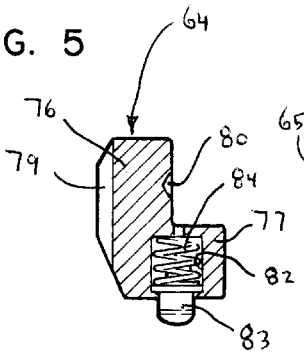
FIG. 8 is a vertical cross section through the L-shaped plug member.
Figure 9:
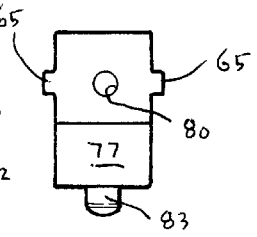
FIG. 9 is a front elevation view of the L-shaped plug member.
Figure 11:
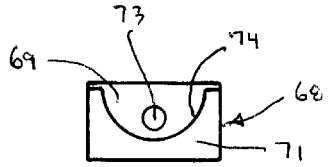
FIG. 11 is an inverted front elevation view of the latch member.

The L-shaped plug member 64 will be described in more detail by referring to FIGS. 8 and 9. It has a vertical portion 76 and a horizontal portion 77. A concave surface 79 is formed in the rear surface of vertical portion 76 to mate with the front surface of the vertical leg portion 21 of trigger guide 20. A recess 80 is formed in the front surface of vertical portion 76 for receiving the front end of set screw 73. A bore hole 82 is formed in the bottom wall of horizontal portion 77 and mounted therein is a release button 83 and a coiled spring 84.

Figure 12:
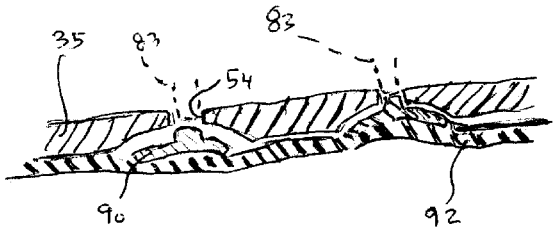
FIG. 12 is a partial vertical cross section of the bottom portion of the lock housing installed on the lock housing support assembly.

FIG. 12 is a partial vertical cross section of the bottom portion of lock housing 26 showing the structure which is utilized to hide the bottom ends of the release buttons 83. Each aperture 54 would have a cap 90 aligned therewith. The strength of coil spring 84 would normally keep cap 90 in its lower most position once release button 83 has been captured in aperture 54. A plastic overmold layer 92 covers the bottom of the respective caps and the bottom wall 35. Unless a person has specific knowledge of the structure of the lock housing and the manner in which it is released, there is no indication that cap members 90 or spring loaded release buttons 83 are above plastic overmold layer 92.

In operation, lock housing 26 is slid onto lock housing support assembly 24 after it has been mounted on the vertical leg portion 21 of the trigger guard 20. The lock housing is pulled to its rearmost position and while this is happening, the release button 83 travels up ramp 55 passing forwardly over first aperture 54 and then dropping into the second aperture 54 adjacent the front end of the lock housing 26. Key 45 is inserted into lock assembly 42 and rotated from a horizontal position to a vertical position causing latch finger 47 to travel upwardly behind front wall 71 of latch member 68. The key 45 can then be removed and even if an attempt is made to press on the bottom surface of lock housing 26 to force button 83 upwardly, latch finger 47 will prevent lock housing 26 from traveling forwardly.

When the owner of handgun 15 wants to keep the gun loaded and ready for use, key 45 is inserted into lock assembly 42 and latch finger 47 is rotated down to a horizontal position. The key is removed and the gun owner can quickly make the gun ready for use in case of danger. At the same time, the gun lock assembly is safe from use by a child since a child would not have the strength to press the release button upwardly a sufficient height to cause the lock housing to be pulled forwardly. Also, absent the knowledge that the release button 83 is located in the bottom of lock housing 26, there is no outward indication that such a structure exists under plastic overmold layer 92.

What is claimed is:

1. A lock gun assembly comprising;

an elongated housing having a front end, a rear end, a top wall, a bottom wall, a left side wall and a right side wall;

a lock housing support assembly having means for rigidly attaching said lock housing support assembly to the vertical leg portion of a trigger guard of a firearm; said lock housing support assembly having a front end, a rear end, a bottom end, a left side and a right side; said lock housing support assembly having a U-shaped bracket that would surround a vertical leg portion of a trigger guard of a firearm; said U-shaped bracket having a front end; and means for telescopically guiding said rear end of said elongated lock housing over said lock housing support assembly to a rearward position where the trigger of a firearm is not accessible.

2. A gun lock assembly as recited in claim 1 wherein said lock housing support assembly further comprises a latch member that is connected to said front end of said U-shaped bracket.

3. A gun lock assembly as recited in claim 2 wherein said lock housing support assembly further comprises a plug member that is removably connected across said front end of said U-shaped bracket to capture a vertical leg portion of a trigger guard of a firearm.

4. A gun lock assembly as recited in claim 3 wherein said plug member has a bottom surface having a spring loaded button extending downwardly therefrom.

5. A gun lock assembly as recited in claim 4 wherein said bottom wall of said elongated lock housing has a first aperture through which said spring loaded button extends to lock said lock housing against longitudinal movement of said lock housing with respect to said lock housing support assembly while preventing access to a trigger of a firearm.

6. A gun lock assembly as recited in claim 5 wherein said bottom wall of said elongated lock housing has a second aperture through which said spring loaded button may extend to lock said lock housing against longitudinal movement of said lock housing with respect to said lock housing support assembly; said second aperture being longitudinally spaced from said first aperture to provide a position which allows a trigger of a firearm to be pulled without requiring said lock housing to be removed from said lock housing support assembly.

7. A gun lock assembly as recited in claim 5 further comprising means for concealing said bottom surface of said spring loaded button when said spring loaded button extends downwardly through said first aperture in said bottom wall of said lock housing.

8. A gun lock housing as recited in claim 6 further comprising means for concealing of said bottom surface of said spring loaded button when spring loaded button extends downwardly through said second aperture in said bottom wall of said lock housing.

9. A gun lock housing as recited in claim 1 in combination with a firearm having a trigger, a trigger guard having a horizontal leg portion and a vertical leg portion, a handle, and a gun barrel; said lock housing support assembly being removably connected to said vertical leg portion.

10. A gun lock assembly comprising:

an elongated housing in the form of an integrally formed tubular sleeve having a front end, a rear end, a top wall, a bottom wall, a left side wall and a right side wall; said top wall having a slot that extends from said rear end of said tubular sleeve more than half the length of said tubular sleeve for removably receiving a trigger guard of a firearm;

a lock housing support assembly having means for rigidly attaching said lock housing support assembly to the vertical leg portion of a trigger guard of a firearm; said lock housing support assembly having a front end, a rear end, a bottom end, a left side and a right side;

means for telescopically guiding said rear end of said elongated lock housing over said lock housing support assembly to a rearward position where the trigger of a firearm is not accessible; and a first means for locking said elongated housing in said rearward position; said first means having a lock assembly mounted in said front end of said tubular sleeve; said lock assembly having a key slot, a lock cylinder and a rotatable latch finger.

11. A gun lock assembly as recited in claim 10 wherein said first means further comprises said front end of said lock housing support assembly having a latch and said latch captures said rotatable latch finger when said latch finger is rotated to a vertical position.

12. A gun lock assembly as recited in claim 10 wherein said means for telescopically guiding said rear end of said elongated lock housing comprises grooves on said inside wall surfaces of said left and right side walls of said lock support assembly.

* * * * *